US011026491B2

(12) United States Patent
Xiao

(10) Patent No.: US 11,026,491 B2
(45) Date of Patent: Jun. 8, 2021

(54) HAIR DRYER

(71) Applicants: LESHOW ELECTRONIC TECHNOLOGY CO. LTD., Hangzhou (CN); BEIJING XIAOMI MOBILE SOFTWARE CO., LTD., Beijing (CN)

(72) Inventor: Zhaoxian Xiao, Beijing (CN)

(73) Assignees: Leshow Electronic Technology Co. Ltd., Hangzhou (CN); Beijing Xiaomi Mobile Software Co., Lted., Beijing (CN)

( * ) Notice: Subject to any disclaimer, the term of this patent is extended or adjusted under 35 U.S.C. 154(b) by 70 days.

(21) Appl. No.: 16/418,653

(22) Filed: May 21, 2019

(65) Prior Publication Data

US 2019/0269219 A1 Sep. 5, 2019

Related U.S. Application Data

(63) Continuation of application No. PCT/CN2018/082276, filed on Apr. 9, 2018.

(30) Foreign Application Priority Data

May 31, 2017 (CN) ..... 201720651352.2

(51) Int. Cl.
*F26B 7/00* (2006.01)
*A45D 20/12* (2006.01)
(Continued)

(52) U.S. Cl.
CPC ..... *A45D 20/12* (2013.01); *A45D 20/10* (2013.01); *A45D 20/20* (2013.01)

(58) Field of Classification Search
CPC ..... A45D 20/12; A45D 20/20; A45D 20/10; A45D 2001/008; A45D 2200/00;
(Continued)

(56) References Cited

U.S. PATENT DOCUMENTS

2005/0097770 A1 5/2005 Sabbatini
2006/0064892 A1 * 3/2006 Matsui ..... B05B 5/001 34/96

(Continued)

FOREIGN PATENT DOCUMENTS

CN 101002641 A 7/2007
CN 101095562 A 1/2008

(Continued)

OTHER PUBLICATIONS

Japanese Office Action (including English translation) issued in JP2019-528725, dated Jun. 30, 2020, 10 pages.

(Continued)

*Primary Examiner* — John P McCormack
(74) *Attorney, Agent, or Firm* — Arch & Lake LLP

(57) ABSTRACT

A hair dryer, including: a housing provided with an air intake and an air outlet, and having an air passage communicating the air intake with the air outlet; a fan installed in the air passage for discharging air from the air intake to the air outlet; and a water particle generator installed in the housing for providing water particles in a direction towards the air outlet; where an installing cavity for installing the water particle generator is provided in the housing, the installing cavity has a cold air passage connected to the air intake and a particle outlet for releasing the water particles, and when in operation of the hair dryer, cold air flowing through the cold air passage that carries the water particles generated by the water particle generator is blown out of the particle outlet.

14 Claims, 4 Drawing Sheets

(51) Int. Cl.
*A45D 20/20* (2006.01)
*A45D 20/10* (2006.01)

(58) Field of Classification Search
CPC ..... B05B 7/0012; B05B 5/001; B05B 5/0533; B05B 5/1691; B05B 5/057
USPC ... 34/393, 389, 391, 96, 283, 597, 380, 381, 34/97
See application file for complete search history.

(56) References Cited

U.S. PATENT DOCUMENTS

| | | | | |
|---|---|---|---|---|
| 2007/0166208 | A1* | 7/2007 | Tanaka | A45D 20/12 422/186.04 |
| 2015/0289623 | A1* | 10/2015 | Matsui | A45D 20/12 34/97 |

FOREIGN PATENT DOCUMENTS

| | | | |
|---|---|---|---|
| CN | 101444359 | A | 6/2009 |
| CN | 101778581 | A | 7/2010 |
| CN | 101801537 | A | 8/2010 |
| CN | 207011892 | U | 2/2018 |
| EP | 2140777 | A2 | 1/2010 |
| JP | 2007275798 | A | 10/2007 |
| JP | 2008073291 | A | 4/2008 |
| JP | 4862779 | B2 | 3/2009 |
| JP | 2009045208 | A | 3/2009 |
| JP | 4877173 | B2 | 4/2009 |
| JP | 2009131734 | A | 6/2009 |
| JP | 2010213739 | A | 9/2010 |
| JP | 2010264455 | A | 11/2010 |
| JP | 2013094193 | A | 5/2013 |
| JP | 2015202129 | A | 11/2015 |
| KR | 20070077076 | A | 7/2007 |

OTHER PUBLICATIONS

Korean Office Action (including English translation) issued in KR20197009656, dated Jun. 27, 2020, 12 pages.
International Search Report and Written Opinion issued in PCT/CN2018/082276, dated Aug. 15, 2018, 11 pages.
The International Search Report to International Application No. PCT/CN2018/082276 with English translation dated Aug. 15, 2018 (5p).

* cited by examiner

HAIR DRYER

CROSS-REFERENCE TO RELATED APPLICATION

This application is based upon and claims priority to PCT patent application No. PCT/CN2018/082276 filed on Apr. 9, 2018 which claims the priority Chinese Patent Application No. 201720651352.2, filed on May 31, 2017, the entire content of which is incorporated herein by reference for all purposes.

TECHNICAL FIELD

The present disclosure generally relates to the field of household electrical appliances, and more particularly, to a hair dryer.

BACKGROUND

As a household electrical appliance, the hair dryer is used for drying wet hair. When using a hair dryer, internal structures of the wet hair may be damaged by the hot air of the hair dryer, and the nutrients may also be evaporated by high temperature. The consequence of long-term use of the hair dryer may be that the hair becomes rough, may not be easy to manage, and even appears to be dry, damaged and yellowed.

SUMMARY

The present disclosure provides a hair dryer and a method of manufacturing a hair dryer.

According to one aspect, a hair dryer is provided. The hair dryer may include a housing provided with an air intake and an air outlet, and where the air intake and the air outlet are communicated via an air passage; a fan installed in the air passage for discharging air from the air intake to the air outlet; and a water particle generator installed in the housing for providing water particles in a direction towards the air outlet; and where an installing cavity for installing the water particle generator is provided in the housing, the installing cavity has a cold air passage connected to the air intake and a particle outlet for releasing the water particles, and when the hair dryer is in operation, cold air flowing through the cold air passage that carries the water particles generated by the water particle generator is blown out of the particle outlet.

According to another aspect, a method of manufacturing a hair dryer is provided. The method may include providing a housing comprising an air intake and an air outlet, and where the air intake and the air outlet are communicated via an air passage; installing a fan in the air passage for discharging air from the air intake to the air outlet; installing a water particle generator in the housing for providing water particles in a direction towards the air outlet; providing an installing cavity for installing the water particle generator in the housing, where the installing cavity has a cold air passage connected to the air intake and a particle outlet for releasing the water particles, and when in operation of the hair dryer, cold air flowing through the cold air passage that carries the water particles generated by the water particle generator is blown out of the particle outlet.

It is to be understood that both the foregoing general description and the following detailed description are exemplary and explanatory only and are not restrictive of the present disclosure.

BRIEF DESCRIPTION OF THE DRAWINGS

The drawings illustrated here are provided for further understanding the examples of the present disclosure and constitute a part of the present disclosure, and are used for explaining the present disclosure together with the examples of the present disclosure and description thereof, rather than improperly limiting the present disclosure.

DETAILED DESCRIPTION

The present disclosure will be further described below with reference to the accompanying drawings.

In order to make objects, technical details and advantages of the present disclosure apparent, the technical solutions of the present disclosure will be described in a clearly and fully understandable way in connection with the specific examples of the present disclosure and the corresponding drawings. It is obvious that the described examples are just a part but not all of the examples of the present disclosure. Based on the examples described herein, those ordinarily skilled in the art can obtain other example(s), without any inventive work, which should be within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Figure 1:
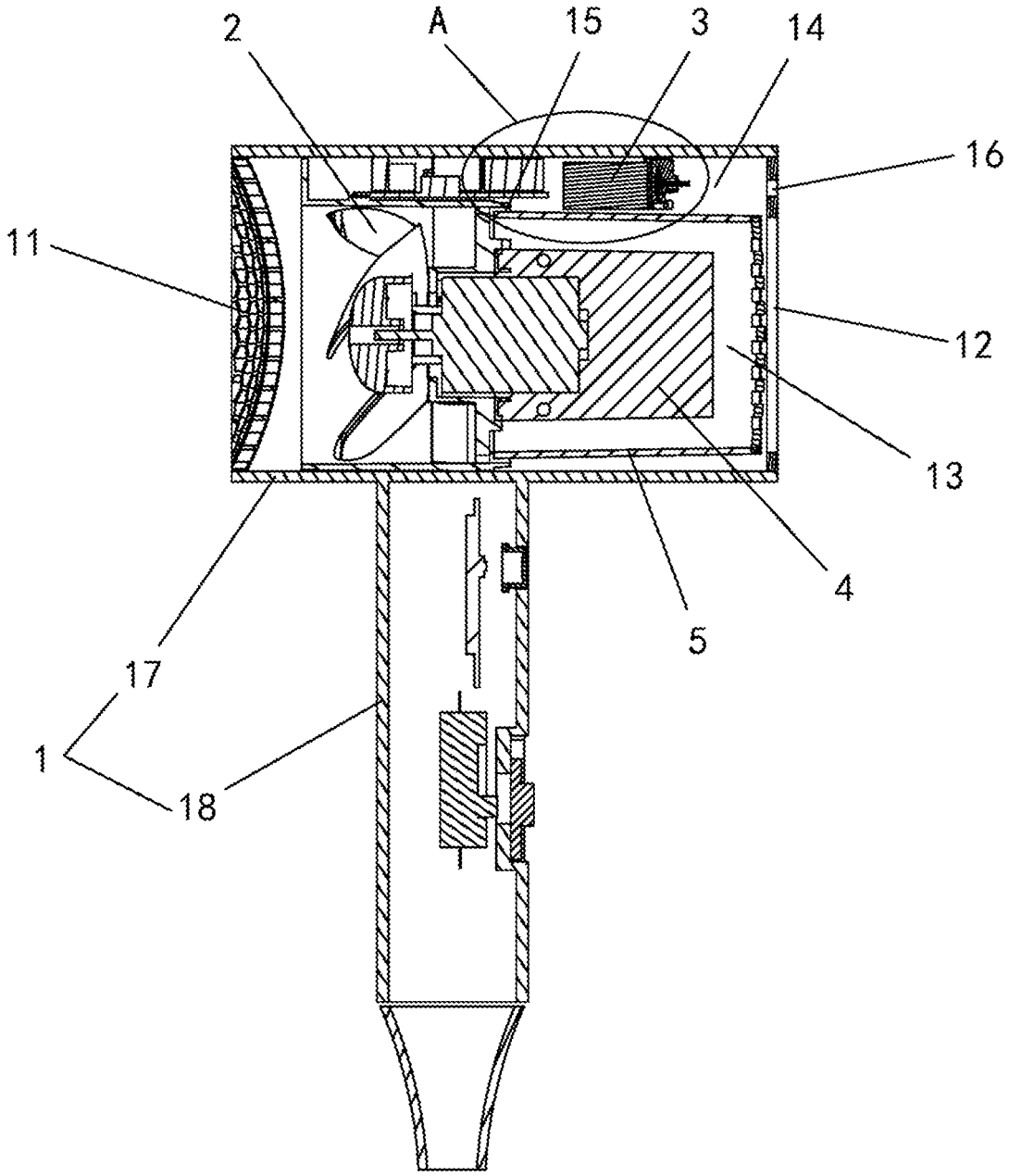
FIG. 1 is a structural diagram of a hair dryer of the present disclosure.
Figure 2:
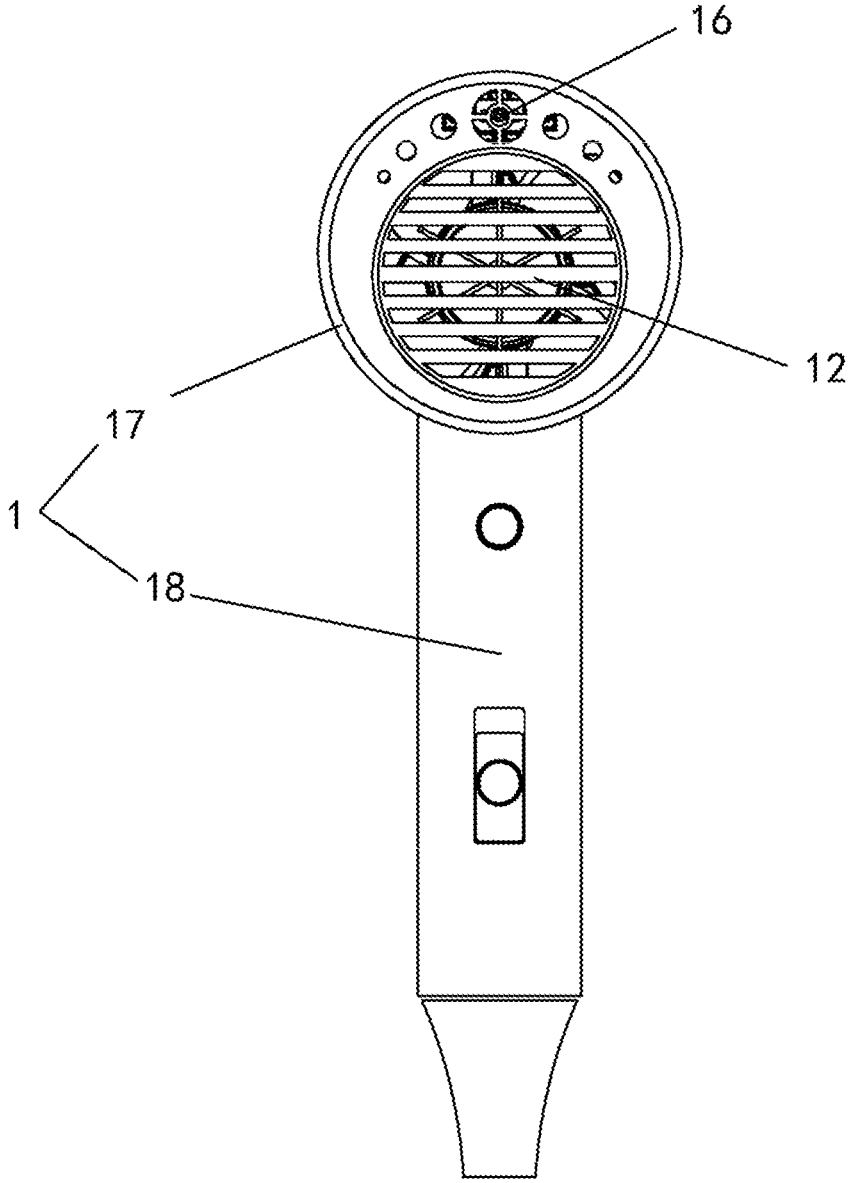
FIG. 2 is a structural diagram of the hair dryer of the present disclosure.
Figure 3:
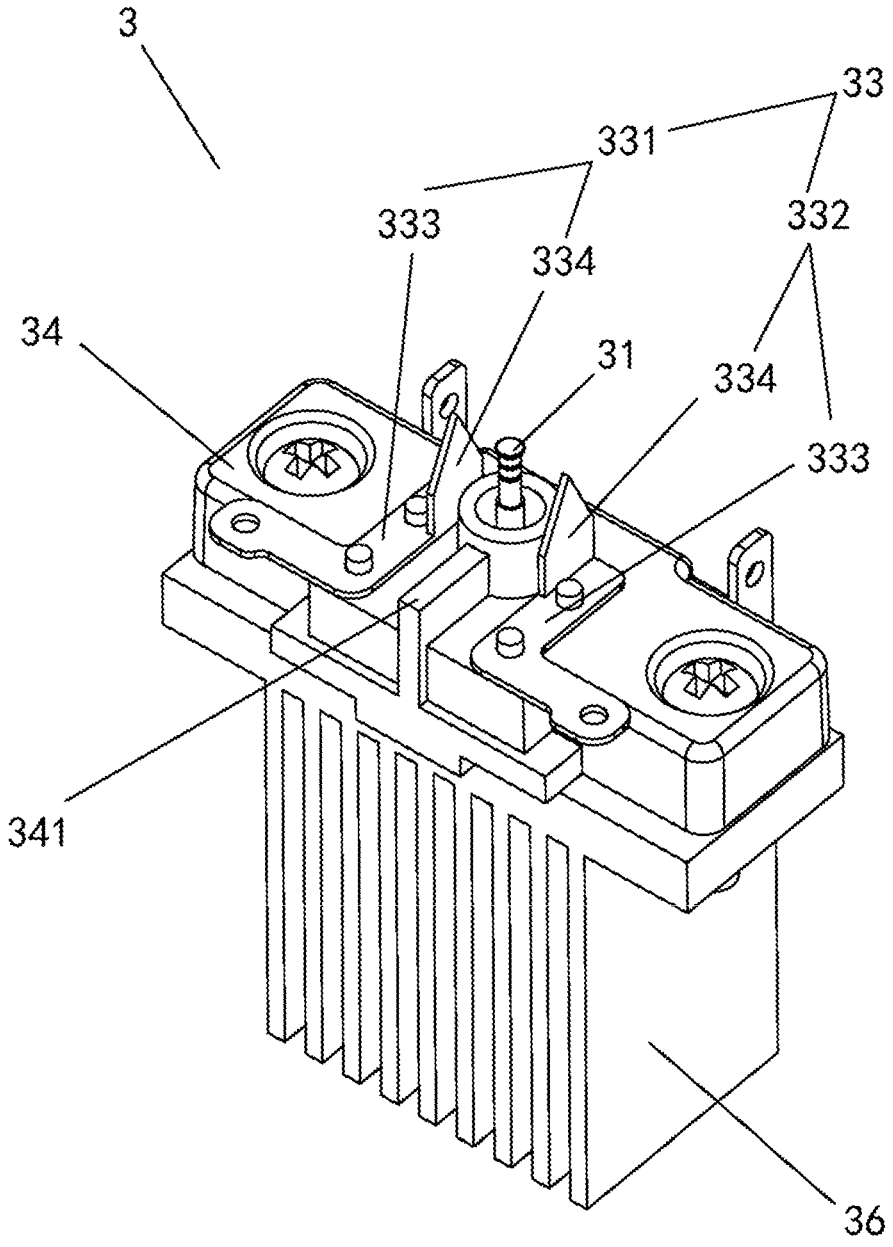
FIG. 3 is a structural diagram of a water particle generator of the present disclosure.
Figure 4:
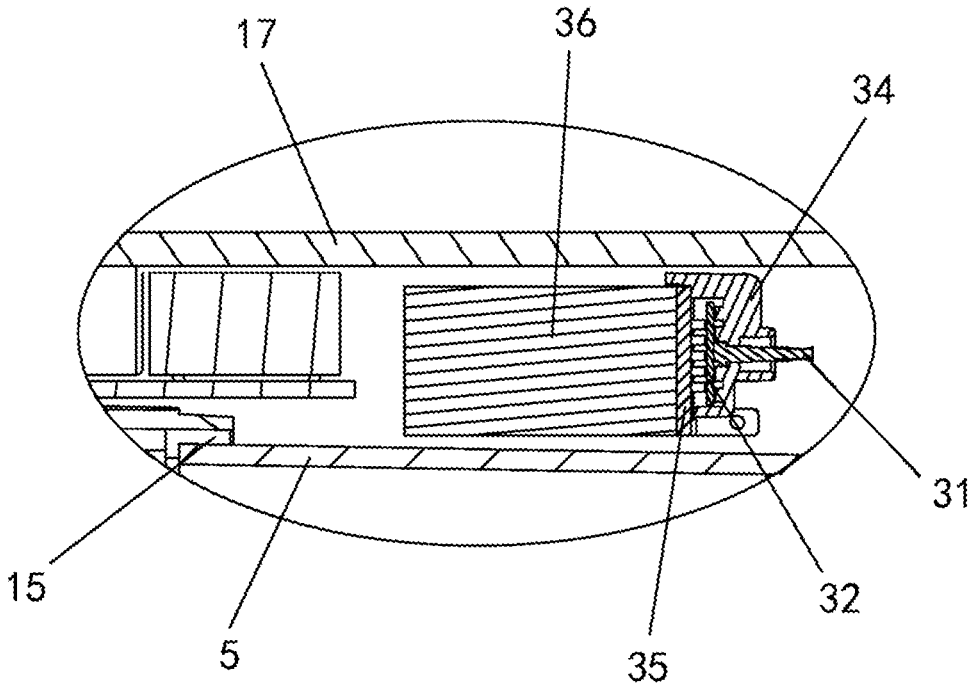
FIG. 4 is an enlarged view of part A in FIG. 1.

Reference numerals shown in FIG. 1 to FIG. 6 are:

1. Housing; 11. Air intake; 12. Air outlet; 13. Air passage; 14. Installing cavity; 15. Cold air passage; 16. Particle outlet; 17. Head; 18. Handle; 2. Fan; 3. Water particle generator; 31. Condensing rod; 32. Refrigeration unit; 33. Discharge electrode group; 331. First electrode; 332. Second electrode; 333. Connecting locking piece; 334. Discharge tip; 34. Insulated bracket; 341. Insulated partition; 35. Heat dissipation module; 36. Cooling fin; 4. Heating rack; 5. Thermal insulation rack.

In order to improve use feeling of the users for a hair dryer, some hair dryers may be equipped a negative ion emitting device on the hair dryer to emit negative ions while blowing, the negative ions neutralize positive charges in the hair, thereby eliminating static electricity, making hair soft, and playing a role in moisturizing and protecting hair.

The present disclosure relates to a hair dryer, as shown in FIGS. 1 to 4, including: a housing 1, provided with an air intake 11, and an air outlet 12 having an air passage 13 communicating the air intake 11 with the air outlet 12; a fan 2 installed in the air passage 13, and discharging air from the air intake 11 to the air outlet 12; and a water particle generator 3 installed in the housing 1 and providing water particles in a direction toward the air outlet 12; wherein an installing cavity 14 for installing the water particle generator 3 is provided in the housing, the installing cavity 14 has a cold air passage 15 connected to the air intake 11, and a particle outlet 16 for releasing water particles, and cold air flowing through the cold air passage 15 carries the water particles generated by the water particle generator 3 out of the particle outlet 16.

The hair dryer of the present disclosure is provided with a water particle generator 3, an installing cavity 14 for installing the water particle generator 3 is provided in the housing, the installing cavity 14 has a cold air passage 15, and a particle outlet 16 letting out water particles, the cold air passage 15 provides moist air for the water particle generator, cold air flowing through the cold air passage 15 is condensed and atomized to generate water particles via the water particle generator 3, and the water particles are carried by the cold air out of the particle outlet 16, realizing the releasing of the water particles.

The water particle generator 3 includes: a condensing rod 31, a refrigeration unit 32, a discharge electrode group 33 and a high voltage power supply, the high voltage power supply applies a high voltage to the discharge electrode group 33 to make the discharge electrode group 33 to generate a high voltage corona, and the discharge electrode group 33 applies the high voltage corona to the condensing rod 31 so as to form atomized water particles by the condensed water attached to the condensing rod 31 under an excitation of the high voltage corona. In the present disclosure, the condensing rod 31 of the water particle generator 3 condenses the water in the cold air flowing through the cold air passage 15, and then the condensed water is attached to the condensing rod 31 and excited by the discharge electrode group 33 to form atomized water particles. The hair dryer of the present disclosure collects and excites the water inside the cold air passage 15, so as to form water particles, the water particles are weakly acidic, and can neutralize alkaline hair damaged due to hair dye or perm, allowing the hair to enter a healthy, weakly acidic state.

The water particle generator is further provided with an insulated bracket 34, and the discharge electrode group 33 and the refrigeration unit 32 are respectively installed on both sides of the insulated bracket 34. In the present disclosure, the discharge electrode group 33 and the refrigeration unit 32 are respectively installed on both sides of the insulated bracket 34, so that the refrigeration unit 32 is insulated from the discharge electrode group 33, thereby avoiding that the refrigeration unit 32 is broken down or malfunctions in the high voltage magnetic fields of due to the high voltage applied to the discharge electrode group 33.

The discharge electrode group 33 includes a first electrode 331 and a second electrode 332 cooperating with each other, and the first electrode 331 and the second electrode 332 are respectively located on both sides of the condensing rod 31. The first electrode 331 and the second electrode 332 surround the condensing rod 31, putting the condensing rod 31 in the high voltage corona generated by the discharge electrode group 33 under the high voltage, thus the positions of the high voltage corona and the condensed water are matched without displacement, and the atomizing effect of the condensed water condensed on the condensing rod 31 is excellent.

The first electrode 331 and the second electrode 332 respectively include a connecting locking piece 333 and a discharge tip 334, and an insulated partition for insulating the connecting locking pieces 333 of the first electrode 331 and the second electrode 332 is further provided on the insulated bracket 34. In order to effectively insulate the first electrode 331 from the second electrode 332, the present disclosure is further provided with the insulated partition 341.

The refrigeration unit 32 is in contact with the condensing rod 31 for cooling the condensing rod 31, the refrigeration unit 32 is further provided with a heat dissipation module 35, the heat dissipation module 35 is integrally provided with the refrigeration unit 32, and the heat dissipation module 35 deviates from the condensing rod 31. In order to improve cooling effect of the refrigeration unit 32, the heat dissipation module 35 is assembled at the side of the refrigeration unit 32 away from the condensing rod 31. The water particle generator 3 is further provided with a cooling fin 36, the cooling fin 36 is in contact with the heat dissipation module 35, and the cooling fin 36 extends in a direction away from the condensing rod 31. The cooling fin 36 promotes heat dissipation of the refrigeration unit 32 in the direction away from the condensing rod 31, assuring cooling effect of the refrigeration unit 32 on the side in contact with the condensing rod 31.

The air passage 13 is further provided with a cylindrical heating rack 4, and a periphery of the cylindrical heating rack 4 is surrounded by a thermal insulation rack 5. The cylindrical heating rack 4 distributes the heat evenly over the air flowing through the cold air passage 15, thereby making the temperature rise control stable; and the periphery of the cylindrical heating rack 4 is surrounded by the thermal insulation rack 5, thereby insulating great heat of the heating rack 4 to avoid the influence of the great heat on the water particle generator 3 in the installing cavity 14, and preventing the water particles from being dried by the great heat.

The installing cavity 14 is located above the air passage 13, and the particle outlet 16 and the air outlet 12 are provided on the same plane. Since the particle outlet 16 and the air outlet 12 are provided on the same plane, a moving distance of the water particles is reduced, thus the water particles and the air for drying wet hair are discharged at the same time on the user's hair, assuring a maximum effect of hydrating of the water particles.

The housing 1 includes a head 17 and a handle 18, the head 17 is a cylinder, and two ends of the cylinder are the air intake 11 and the air outlet 12 respectively. In the present disclosure, the hair dryer adopts a cylinder head 17, such that the blown air discharged from the air outlet 12 and the air flow with the water particles from the particle outlet 16 are discharged as parallel as possible, to avoid cross interference of the flows to dry water particles dried and decrease content of water particles. Furthermore, two ends of the cylinder are the air intake 11 and the air outlet 12 respectively, which can minimize pneumatic pressure loss consequently reduce energy consumption and promote hair-drying efficiency of the hair dryer.

The present disclosure provides a hair dryer capable of releasing water particles.

The present disclosure adopts the following technical solution: a hair dryer, including:

a housing, provided with an air intake and an air outlet, and having an air passage communicating the air intake with the air outlet;

a fan installed in the air passage, and discharging air from the air intake to the air outlet; and a water particle generator installed in the housing and providing water particles in a direction toward the air outlet;

wherein an installing cavity for installing the water particle generator is provided in the housing, the installing cavity has a cold air passage connected to the air intake, and a particle outlet for releasing the water particles, and cold air flowing through the cold air passage carries the water particles generated by the water particle generator out of the particle outlet.

The hair dryer of the present disclosure is provided with a water particle generator, and is provided with an installing cavity for installing the water particle generator in the housing. The installing cavity has a cold air passage connected to the air intake, and a particle outlet for releasing water particles. The cold air passage provides moisture air for the water particle generator, the cold air flowing through the cold air passage generates water particles after passing through the water particle generator, and the water particles are carried by the cold air out of the particle outlet, thereby realizing the releasing of the water particles.

The technical solution described above may also be further improved by the following technical measures.

The water particle generator includes: a condensing rod, a refrigeration unit, a discharge electrode group and a high voltage power supply, a high voltage is applied to the discharge electrode group to make the discharge electrode group to generate a high voltage corona, and the discharge electrode group applies the high voltage corona to the condensing rod so as to form atomized water particles by the condensed water attached to the condensing rod under an excitation of the high voltage corona. In the present disclosure, the condensing rod of the water particle generator condenses the water in the cold air flowing through the cold air passage, and then the condensed water is attached on the condensing rod and is excited by the discharge electrode group to form the atomized water particles. The hair dryer of the present disclosure collects and excites the water inside the cold air passage so as to form the water particles, and the water particles are weakly acidic, and can neutralize alkaline hair damaged due to hair dye or perm, thereby allowing the hair to enter a healthy, weakly acidic state.

The water particle generator is further provided with an insulated bracket, and the discharge electrode group and the refrigeration unit are respectively installed on both sides of the insulated bracket. In the present disclosure, the discharge electrode group and the refrigeration unit are respectively installed on both sides of the insulated bracket, in this way, the refrigeration unit is insulated from the discharge electrode group, thereby avoiding that the refrigeration unit is broken down or malfunctions in the high voltage magnetic fields due to the high voltage applied to the discharge electrode group.

The discharge electrode group includes a first electrode and a second electrode cooperating with each other, and the first electrode and the second electrode are respectively located on both sides of the condensing rod. The condensing rod is surrounded by the first electrode and the second electrode, and the condensing rod is in the high voltage corona generated by the discharge electrode group under the high voltage. Thus, the positions of the high voltage corona and the condensed water are matched without displacement, and the atomizing effect of the condensed water condensed on the condensing rod is excellent.

The first electrode and the second electrode respectively include a connecting locking piece and a discharge tip, and an insulated partition for insulating the connecting locking piece of the first electrode and the connecting locking piece of the second electrode is further provided on the insulated bracket. The insulated partition insulates the first electrode and the second electrode effectively.

The refrigeration unit is in contact with the condensing rod for cooling the condensing rod, the refrigeration unit is further provided with a heat dissipation module, the heat dissipation module is integrally provided with the refrigeration unit, and the heat dissipation module deviates from the condensing rod. In order to improve cooling effect of the refrigeration unit, the heat dissipation module is configured at the side of the refrigeration unit deviating from the condensing rod.

The water particle generator is further provided with a cooling fin, the cooling fin is in contact with the heat dissipation module, and the cooling fin extends in a direction deviating from the condensing rod. The cooling fin promotes heat dissipation of the refrigeration unit in the direction deviating from the condensing rod, assuring cooling effect of the refrigeration unit at the side in contact with the condensing rod.

The air passage is further provided with a cylindrical heating rack, and a periphery of the cylindrical heating rack is surrounded by a thermal insulation rack. The cylindrical heating rack distributes the heat evenly over the air flowing through the cold air passage, thereby making the temperature rise control stable; and the periphery of the cylindrical heating rack is surrounded by the thermal insulation rack, thereby insulating great heat of the heating rack to avoid the influence of the great heat on the water particle generator in the installing cavity, and preventing the water particles from being dried by the great heat.

The installing cavity is located above the air passage, and the particle outlet and the air outlet are provided on the same plane. Since the particle outlet and the air outlet are provided on the same plane, a moving distance of the water particles is reduced, thus the water particles and the air for drying wet hair are discharged at the same time on the user's hair, assuring a maximum effect of hydrating of the water particles.

The housing includes a head and a handle, the head is a cylinder, and two ends of the cylinder are the air intake and the air outlet respectively. In the present disclosure, the hair dryer adopts a cylinder head, such that the blown air for drying hair discharged from the air outlet and the air flow with the water particles discharged from the particle outlet are discharged as parallel as possible, to avoid cross interference of the two flows to dry water particles and decrease content of water particles. Furthermore, two ends of the cylinder are the air intake and the air outlet respectively, which can minimize pneumatic pressure loss, reduce energy consumption and promote hair-drying efficiency of the hair dryer.

Adopting the technical solution described above, the present disclosure has the following advantages.

The hair dryer of the present disclosure has the function of releasing weakly acidic water particles, which can neutralize alkaline hair damaged due to hair dye or perm. At the same time, the hair dryer is safe and reliable, the atomizing effect is perfect, the pneumatic pressure loss is minimized, the energy consumption is reduced and the hair-drying efficiency of the hair dryer is promoted.

The present disclosure discloses a method of manufacturing a hair dryer. The method may include providing a housing comprising an air intake and an air outlet, and where the air intake and the air outlet are communicated via an air passage; installing a fan in the air passage for discharging air from the air intake to the air outlet; installing a water particle generator in the housing for providing water particles in a direction towards the air outlet; providing an installing cavity for installing the water particle generator in the housing, where the installing cavity has a cold air passage connected to the air intake and a particle outlet for releasing the water particles, and when in operation of the hair dryer, cold air flowing through the cold air passage that carries the water particles generated by the water particle generator is blown out of the particle outlet.

The method may also include providing a condensing rod, a refrigeration unit, a discharge electrode group and a high voltage power supply for the water particle generator; and when in operation of the hair dryer, applying a high voltage by the high voltage power supply to the discharge electrode group to make the discharge electrode group to generate a high voltage corona, and applying the high voltage corona by the discharge electrode group to the condensing rod so as to form atomized water particles by the condensed water attached to the condensing rod under an excitation of the high voltage corona.

The method may include providing an insulated bracket with the water particle generator; and installing the discharge electrode group and the refrigeration unit on both sides of the insulated bracket.

The method may include providing a first electrode and a second electrode with the discharge electrode group, wherein the first electrode and the second electrode cooperate with each other, and are located on both sides of the condensing rod.

The method may include providing a connecting locking piece and a discharge tip respectively with the first electrode and the second electrode; and providing an insulated partition on the insulated bracket for insulating connecting locking pieces of the first electrode and the second electrode.

In the method, the refrigeration unit may be in contact with the condensing rod for cooling the condensing rod, the refrigeration unit may be further provided with a heat dissipation module, the heat dissipation module may be integrally provided with the refrigeration unit, and the heat dissipation module may be disposed away from the condensing rod.

The method may include providing a cooling fin with the water particle generator wherein the cooling fin is in contact with the heat dissipation module, and the cooling fin extends in a direction away from the condensing rod.

The method may include providing a cylindrical heating rack with the air passage; and surrounding a periphery of the cylindrical heating rack using a thermal insulation rack.

In the method, the installing cavity may be located above the air passage, and the particle outlet and the air outlet may be provided on a same plane.

The method may further include providing a head and a handle with the housing, where the head is a cylinder, and two ends of the cylinder are the air intake and the air outlet.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The examples described above are merely exemplary of the present disclosure, rather than all examples of the present disclosure. Various modifications may be made by those skilled in the art in accordance with the principles of the present disclosure. Any modifications without departing from the spirit of the present disclosure shall fall within the scope of the present disclosure.

What is claimed is:

1. A hair dryer, comprising:

a housing provided with an air intake and an air outlet, and wherein the air intake and the air outlet are communicated via an air passage;

a fan installed in the air passage for discharging air from the air intake to the air outlet; and a water particle generator installed in the housing for providing water particles in a direction towards the air outlet, wherein an installing cavity for installing the water particle generator is provided in the housing, the installing cavity has a cold air passage connected to the air intake and a particle outlet for releasing the water particles, and when the hair dryer is in operation, cold air flowing through the cold air passage that carries the water particles generated by the water particle generator is blown out of the particle outlet, wherein the water particle generator further comprises a condensing rod, a refrigeration unit, a discharge electrode group and a high voltage power supply, wherein the high voltage power supply applies a high voltage to the discharge electrode group to make the discharge electrode group to generate a high voltage corona, and the discharge electrode group applies the high voltage corona to the condensing rod so as to form atomized water particles by condensed water attached to the condensing rod under an excitation of the high voltage corona, and wherein the water particle generator further comprises an insulated bracket, and the discharge electrode group further comprises a first electrode and a second electrode, wherein the first electrode and the second electrode cooperate with each other, and are located on opposite sides of the condensing rod, the first electrode and the second electrode respectively comprise a connecting locking piece and a discharge tip, and the connecting locking piece is disposed on the insulated bracket and the insulated bracket is disposed on an insulated partition for insulating connecting locking pieces of the first electrode and the second electrode.

2. The hair dryer of claim 1, wherein the discharge electrode group and the refrigeration unit are installed on both sides of the insulated bracket.

3. The hair dryer of claim 1, wherein the refrigeration unit is in contact with the condensing rod for cooling the condensing rod, the refrigeration unit is further provided with a heat dissipation module, the heat dissipation module is integrally provided with the refrigeration unit, and the heat dissipation module is disposed away from the condensing rod.

4. The hair dryer of claim 3, wherein the water particle generator further comprises a cooling fin, the cooling fin is in contact with the heat dissipation module, and the cooling fin extends in a direction away from the condensing rod.

5. The hair dryer of claim 1, wherein the air passage is provided with a cylindrical heating rack, and a periphery of the cylindrical heating rack is surrounded by a thermal insulation rack.

6. The hair dryer of claim 1, wherein the installing cavity is located above the air passage, and the particle outlet and the air outlet are provided on a same plane.

7. The hair dryer of claim 1, wherein the housing comprises a head and a handle, the head is a cylinder, and two ends of the cylinder are the air intake and the air outlet.

8. A method of manufacturing a hair dryer, comprising:

providing a housing comprising an air intake and an air outlet, and wherein the air intake and the air outlet are communicated via an air passage;

installing a fan in the air passage for discharging air from the air intake to the air outlet;

installing a water particle generator in the housing for providing water particles in a direction towards the air outlet;

providing an installing cavity for installing the water particle generator in the housing, wherein the installing cavity has a cold air passage connected to the air intake and a particle outlet for releasing the water particles, and when in operation of the hair dryer, cold air flowing through the cold air passage that carries the water particles generated by the water particle generator is blown out of the particle outlet;

providing a condensing rod, a refrigeration unit, a discharge electrode group and a high voltage power supply for the water particle generator;

when in operation of the hair dryer, applying a high voltage by the high voltage power supply to the discharge electrode group to make the discharge electrode group to generate a high voltage corona, and applying the high voltage corona by the discharge electrode group to the condensing rod so as to form atomized water particles by condensed water attached to the condensing rod under an excitation of the high voltage corona;

providing an insulated bracket with the water particle generator;

providing a first electrode and a second electrode with the discharge electrode group, wherein the first electrode and the second electrode cooperate with each other, and are located on opposite sides of the condensing rod;

providing a connecting locking piece and a discharge tip respectively with the first electrode and the second electrode; and providing an insulated partition, wherein the connecting locking piece is disposed on the insulated bracket and the insulated bracket is disposed on the insulated partition for insulating connecting locking pieces of the first electrode and the second electrode.

9. The method of claim 8, further comprising:

installing the discharge electrode group and the refrigeration unit on both sides of the insulated bracket.

10. The method of claim 8, wherein the refrigeration unit is in contact with the condensing rod for cooling the condensing rod, the refrigeration unit is further provided with a heat dissipation module, the heat dissipation module is integrally provided with the refrigeration unit, and the heat dissipation module is disposed away from the condensing rod.

11. The method of claim 10, further comprising:

providing a cooling fin with the water particle generator wherein the cooling fin is in contact with the heat dissipation module, and the cooling fin extends in a direction away from the condensing rod.

12. The method of claim 8, further comprising:

providing a cylindrical heating rack with the air passage; and surrounding a periphery of the cylindrical heating rack using a thermal insulation rack.

13. The method of claim 8, wherein the installing cavity is located above the air passage, and the particle outlet and the air outlet are provided on a same plane.

14. The method of claim 8, further comprising:

providing a head and a handle with the housing, wherein the head is a cylinder, and two ends of the cylinder are the air intake and the air outlet.

* * * * *